US006932279B2

(12) United States Patent
Burcham

(10) Patent No.: US 6,932,279 B2
(45) Date of Patent: Aug. 23, 2005

(54) WOBBLING SPRINKLER HEAD

(75) Inventor: Gregory S. Burcham, Clermont, FL (US)

(73) Assignee: Senninger Irrigation Inc., Clermont, FL (US)

( * ) Notice: Subject to any disclaimer, the term of this patent is extended or adjusted under 35 U.S.C. 154(b) by 0 days.

(21) Appl. No.: 10/693,417

(22) Filed: Oct. 27, 2003

(65) Prior Publication Data

US 2005/0087622 A1 Apr. 28, 2005

(51) Int. Cl.[7] ..... B05B 3/04
(52) U.S. Cl. ..... 239/222.17; 239/222.11; 239/222.21; 239/231; 239/381; 239/524
(58) Field of Search ..... 239/222.11, 222.17, 239/222.19, 222.21, 231, 380, 381, 518, 239/524

(56) References Cited

U.S. PATENT DOCUMENTS 3,009,648 A 11/1961 Hait
3,034,728 A 5/1962 Hruby, Jr.
3,091,400 A 5/1963 Aubert
4,487,368 A 12/1984 Clearman
4,773,594 A 9/1988 Clearman
5,381,960 A 1/1995 Sullivan et al.
5,950,927 A 9/1999 Elliott et al.
6,176,440 B1 1/2001 Elliott
6,382,525 B1 * 5/2002 Santiesteban et al. .. 239/222.11
6,439,477 B1 * 8/2002 Sweet et al. ..... 239/222.17

* cited by examiner

*Primary Examiner*—Steven J. Ganey
(74) *Attorney, Agent, or Firm*—William M. Hobby, III

(57) ABSTRACT

A wobbling sprinkler head has a sprinkler head main frame having a nozzle base having a nozzle therein and at least one arm extending therefrom supporting a deflector supporting base. The nozzle base is attached to a water supply and has a water inlet for directing water through the nozzle and against a water deflector head. The water deflector head has a shaft movably riding in the deflector supporting base and has a water deflecting surface attached to one end of the shaft and positioned to deflect water being emitted from the nozzle and a counterweight attached to the other end thereof to dampen vibrations. The water deflecting surface has a predetermined shape to cause rotation of the water deflector head responsive to water being directed thereagainst and has a protrusion extending therefrom to force an initial tilt and wobbling action.

10 Claims, 2 Drawing Sheets

WOBBLING SPRINKLER HEAD

BACKGROUND OF THE INVENTION

The present invention relates to a wobbling sprinkler head and especially to a wobbling sprinkler head for use in irrigation systems and the like.

There have been a number of wobbling sprinkler heads used in the past in which the water distribution head of the sprinkler, instead of being rotated in a smooth rotation or instead of following one of the other sprinkler patterns, has a water distribution head which wobbles in a rotating fashion to provide a more even distribution of water. In the Clearman patents, U.S. Pat. No. 4,487,368 and U.S. Pat. No. 4,773,594, a control pattern wobbling sprinkler is provided in which a rotating sprinkler head has a wobbling water distribution head mounted on the end thereof which has a plurality of vanes formed in the wobbling portion of the head to force a wobbling motion which results from the loose connection between the distribution head and the supporting arm of the sprinkler head. In the sprinkler of these two patents, a base is provided for ground support and a rotating sprinkler head has the end of the rotating arm bent at an angle so that the loosely attached wobbling head tilts groundward when not being used. Upon initiation of water under pressure to the head, the head is already in a cocked position and forces a rotating action which causes a wobbling rotation of the water head portion. In the J. M. Hait patent, U.S. Pat. No. 3,009,648, an irrigation system is provided in which the sprinkler head has a rotating stream of water issuing therefrom but allows a deflection head to move back and forth. In J. O. Hruby, Jr., U.S. Pat. No. 3,034,728, a lawn sprinkler is shown which has a centrally disposed and vertically extending stem which is made to rotate by the action of the water passing through the sprinkler. The stem is loosely mounted and has an uneven deflecting portion to produce a rotating action of the spray. In the M. S. Aubert patent, U.S. Pat. No. 3,091,400, a dishwashing machine has a rotary wobbling spring head which is driven by the water momentum to wobble the head in a dishwasher.

In Applicant's U.S. Pat. No. 5,381,960, a wobbling irrigation sprinkler head includes a magnet for the initial tilt in a wobbling irrigation sprinkler head for use on a self-propelled mechanical moving irrigation system, such as a center pivot field irrigation system, having the wobbling sprinkler head facing downward from the water supply conduit. This sprinkler head produces a wobbling motion as a result of the nozzle directing water onto a deflector pad having a predetermined shape with water deflecting grooves which rotates and wobbles the water deflecting head. A magnet is mounted in the sprinkler head base to attract a ferric metal washer mounted in the wobbling deflecting head to tilt the wobbling water deflector head relative to the base to cock the deflector head to initiate the wobbling in the deflector head.

In Applicant's prior U.S. Pat. No. 5,950,927 for a Wobbling Sprinkler Head, a wobbling irrigation sprinkler head is for use on a self-propelled mechanical moving irrigation system, such as a center pivot field irrigation system, in which the sprinkler heads face downward from the water supply conduit. This sprinkler head produces a wobbling motion as a result of the nozzle directing water onto a deflector pad having a predetermined shape with water deflecting grooves which cause a rotation and wobbling of the water deflecting head. The wobbling motion is produced by a wobble mechanism which has a pair of interacting wobble generating members, one mounted on the water deflecting head and the other mounted on the sprinkler body to keep the water deflection head titled at an angle to the water exiting the water nozzle. The interaction of the protruding members forces the deflection head to start wobbling as the deflection head rotates and maintains the wobble. The water deflection head is blocked from the center axis position to keep the water deflecting surface at an angle to the stream of water being emitted from the nozzle.

One of the problems that occurs with commercial wobble sprinkler heads is the vibration created in the sprinkler head by the wobbling action which can result in wear and premature failure of a wobbling sprinkler head. The present invention is a wobbling sprinkler head which dampens the vibration in the sprinkler head. A water deflection head is rotated by a stream of water from a water nozzle.

In Applicant's U.S. Pat. No. 6,176,440, the interaction of a pair of wobble generating members forces the water deflection head to start wobbling as the deflection head rotates. The water deflection head is prevented from the center position by the interacting wobble generating members to keep the water deflecting surface at an angle to the stream of water being emitted from the nozzle. Once the deflection head starts rotating, the protruding members do not touch since the circle of rotation is outside a stationary wobble generating member. A predetermined mass is removably attached to the sprinkler head along the base of the sprinkler head to dampen vibrations in the sprinkler head generated by the wobbling deflector head. The mass is removably attached to allow for the change of the mass depending upon the operating conditions of the sprinkler head.

In the present invention, a wobbling sprinkler head has a wobbling deflector located below the nozzle and is weighted to counterbalance the deflector head and reduce vibration.

SUMMARY OF THE INVENTION

A wobbling sprinkler head has a sprinkler head main frame having a nozzle base having a nozzle therein and at least one arm extending therefrom supporting a deflector supporting base. The nozzle base is attached to a water supply and has a water inlet for directing water through the nozzle. A water deflector head has a shaft movably attached to the deflector supporting base and a water deflecting surface attached to one end of the shaft and positioned to deflect water being emitted from the nozzle. The water deflecting surface has a predetermined shape to cause movement of the water deflector head responsive to water being directed thereagainst. The shaft has a counterbalancing weight on the other end thereof. The water deflecting surface has a protrusion extending therefrom and extends adjacent one side of the nozzle base to thereby tilt the water deflecting head to one side of the nozzle output to thereby cause the water deflector head to wobble responsive to water directed thereagainst from the nozzle. The shaft has a spool bushing between the ends thereof and rides in a deflector base opening. The deflector base opening is large enough to allow the shaft to tilt and wobble during rotation. The water deflection head has a wobbling motion while distributing water from the sprinkler head and at the same time dampens vibrations with the counterweight. The water deflecting surface and the counterweight are removably attached to the shaft by a threaded connection or the like so that the counterweight can be easily changed.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
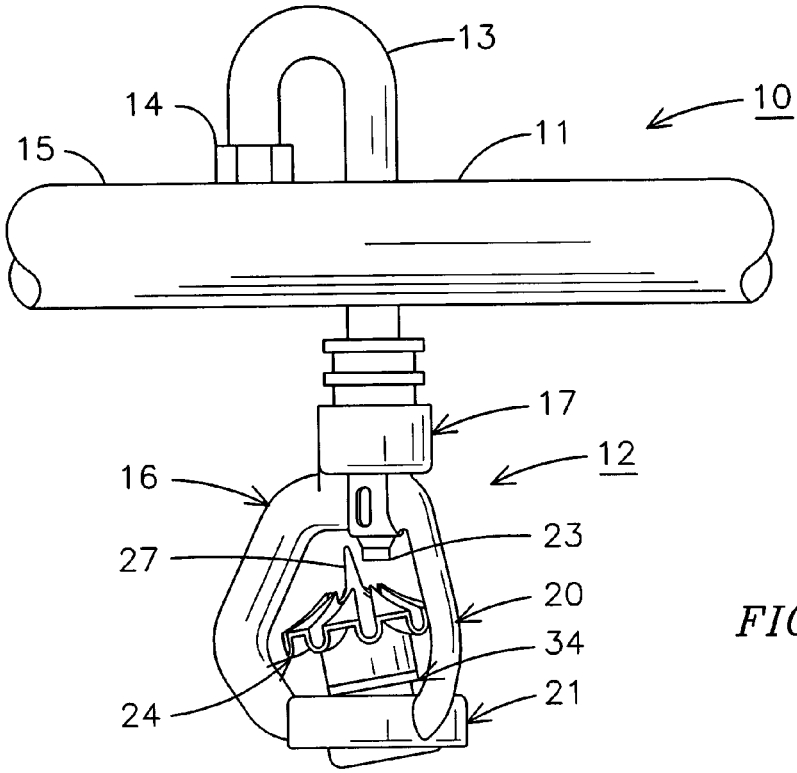
FIG. 1 is a side elevation of a portion of the water conduit having the present sprinkler head.

Referring to FIG. 1 of the drawings, a portion of a water conduit of an irrigation system 10 has a central irrigation conduit or water supply pipe 11 having a plurality of sprinkler heads 12 attached thereto in a spaced relationship to each other. Each sprinkler head 12 is connected to a drop pipe 13 which is connected with a coupling 14 to the top 15 of the pipe 11. The pipe 13 may be any length desired and has a U-shaped bend and has the sprinkler head 12 attached thereto.

Figure 2:
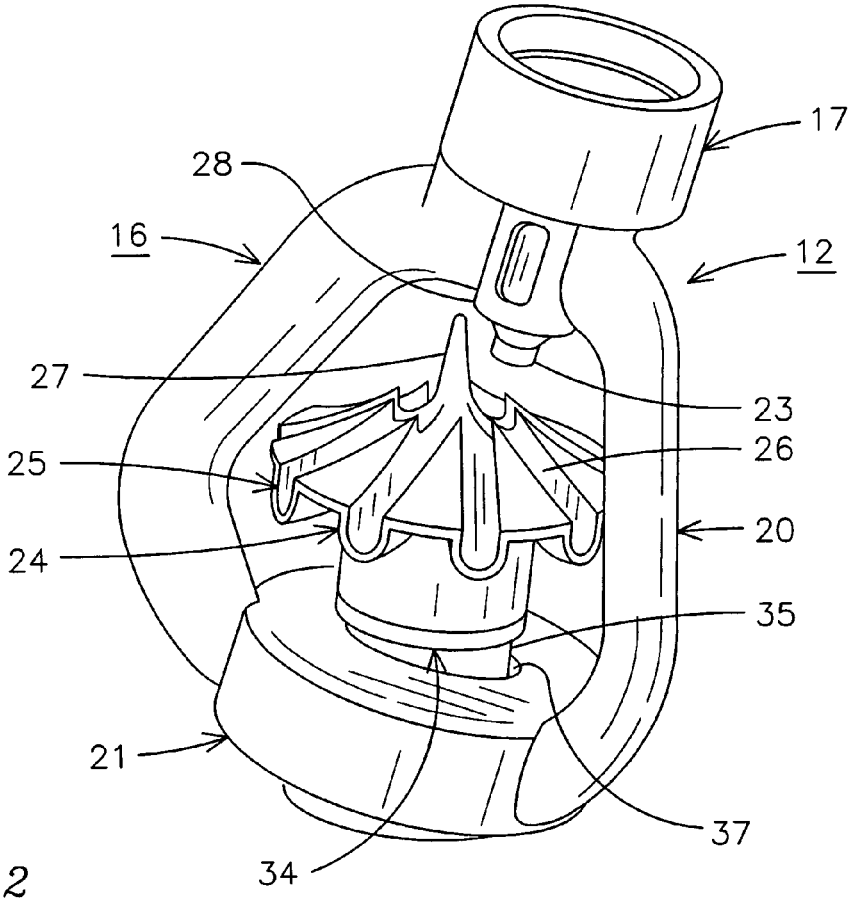
FIG. 2 is a perspective view of a wobbling sprinkler head in accordance with the present invention.
Figure 3:
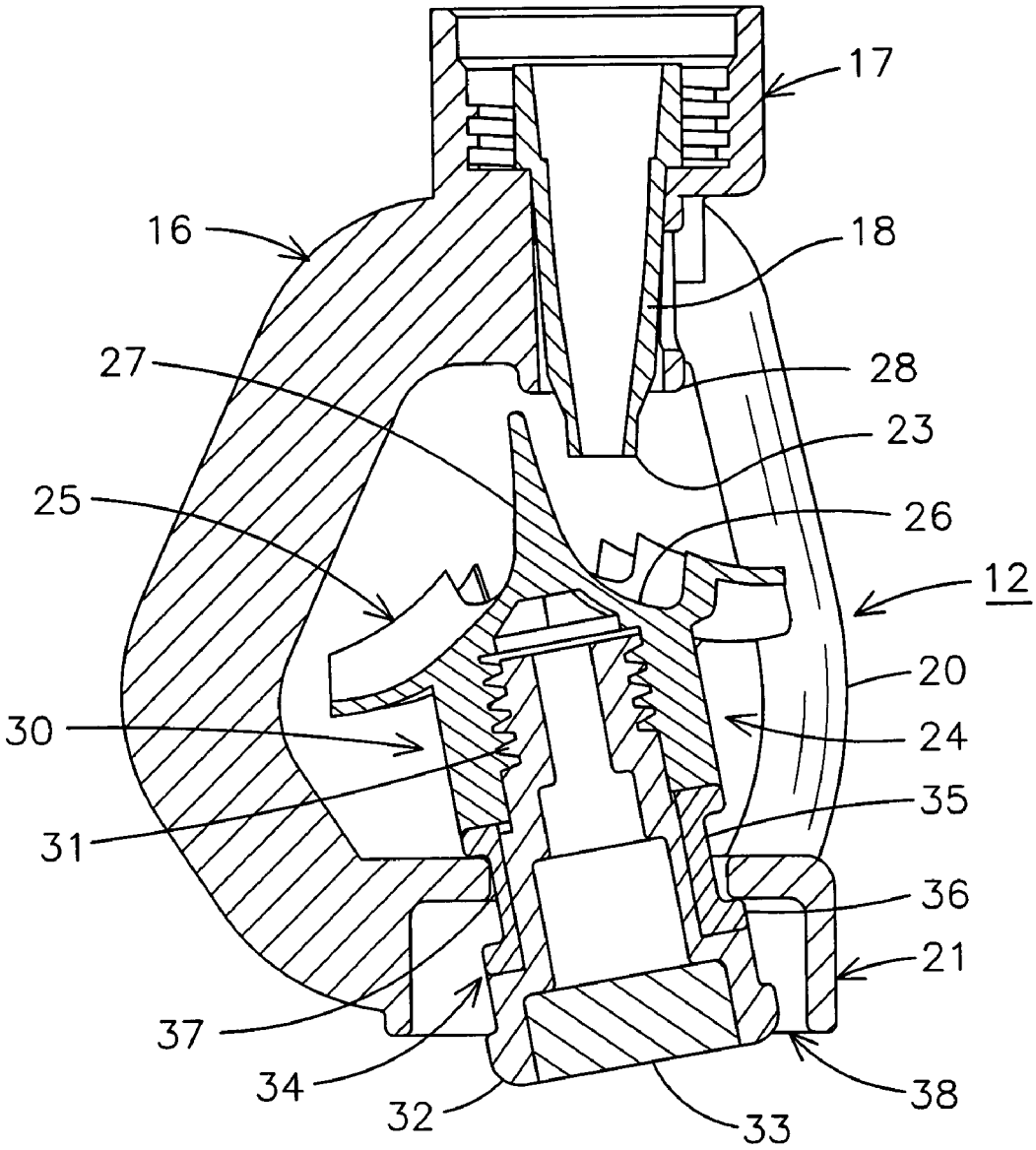
FIG. 3 is a cutaway elevation of the sprinkler head of FIGS. 1 and 2.

The sprinkler head 12, as seen in FIGS. 1–3, includes a main frame 16 having a nozzle base 17 having a nozzle 18 therein. The sprinkler head main frame 16 also has a plurality of supporting arms 20 extending from the nozzle base 17 and attached to a deflector supporting base 21, leaving an open space 22 between the nozzle base 17 and the deflector supporting base 21 with the end 23 of the nozzle 18 facing directly downward towards the deflector supporting base 21. A water deflecting head 24 has a water deflecting surface 25 having a plurality of arcuate grooves 26 therein for directing water being emitted from the nozzle 18 tip 23 thereagainst. The water deflecting surface or pad 25 has a protrusion 27 extending from the center thereof and is generally cone-shaped and positioned so that it extends adjacent the annular end 28 of the nozzle base 17. The water deflector surface 25 is attached to a deflector mount or base 30 at one end thereof with threads 31. The deflector mount 30 has a shaft 32 attached thereto. A counterweight 33 is pressed into the base of the shaft 32. A spool bushing 34 is positioned between the ends of the deflector mount and the shaft 32. The spool bushing 34 has a center groove 35 with a pair of circular flanges 36 on either side thereof. The groove 35 is sized to fit loosely within the hole 37 so as to allow the spool and shaft to rotate on the deflector supporting base 21 and is sufficiently loose to allow the water deflecting head 24 to wobble as it rotates. The protrusion 27 always forces the water deflector head 24 to be in a tilted position so that when rotating, it is forced to wobble as the water being emitted from the nozzle 18 is directed against the water deflecting surface 25 and into the grooves 26. The water deflecting surface directs the water outwardly to the area being sprinkled or irrigated. The angle of the grooves 26 forces rotation of the water deflecting head 24 which is held to the deflector supporting base 21 by virtue of the loose mounting of the spool bushing 34 within the water deflector head supporting base opening 37. The water deflector supporting base, as seen in FIG. 3, has an open bottom 38 to allow access to the counterweight 33 which can advantageously be replaced or changed to vary the characteristics of the wobble of the sprinkling head. The weight 33 tends to hold the wobbling water deflecting head 24 in a generally upright position and dampens vibrations created by the wobbling of the head.

The sprinkler head of the present invention utilizes a tripod frame with three supporting arms 20. It allows a deflector head to wobble on a spool bushing mounted to a shaft mounted in a deflector support base and having a counterweight on the bottom of the shaft supporting the deflector pad or surface. Startability is substantially enhanced by extending the apex of the deflector pad upwardly beyond the end of the nozzle housing to create an interference between the water deflector head and the nozzle housing to force the assembly into a tipped position to assure that the water deflector head starts its rotation and wobble. Once the rotation is initiated, the upwardly extending protrusion is no longer in contact with a nozzle housing. Vibration is substantially reduced by counterbalancing of the rotational forces of the water deflector head and is accomplished by adjusting the counterweight 33. Also varying the distance of the counterweight from the rotation point allows a single weight to balance the water deflection head in a variety of flow ranges.

It should be clear at this time that an improved wobbling irrigation sprinkler head has been provided which uses a wobbling deflector head mounted below the nozzle and which counterbalances the head with a weight mounted to one end of a shaft having the wobbling deflecting pad mounted to the other end of the shaft. The shaft is supported with a spool bushing riding in an opening in the deflector head supporting base. However, the present invention is not to be construed as limited to the forms shown which are to be considered illustrative rather than restrictive.

What is claimed is:

1. A wobbling sprinkler head comprising:

a sprinkler head main frame having a nozzle base having a nozzle therein and at least one arm extending therefrom supporting a deflector supporting base, said nozzle base being attached to a water supply and having a water inlet for directing water through said nozzle;

a water deflecting head having a shaft movably attached to said deflector supporting base and having a water deflecting surface attached to one end of said shaft and positioned to deflect water being emitted from said nozzle, said water deflector surface having a predetermined shape to cause movement of said water deflector head responsive to water being directed thereagainst, and said shaft having a counterbalancing weight on the other end thereof; and said water deflecting surface having an elongated protrusion extending from the center thereof to one side of said nozzle to thereby tilt said water deflecting head to one side of said nozzle to thereby cause said water deflecting head to wobble responsive to water directed against said water deflecting surface from said nozzle;

whereby said water deflecting head has a wobbling motion while distributing water from said sprinkler head while dampening vibrations with a counterbalancing weight.

2. A wobbling sprinkler head in accordance with claim 1 in which said water deflecting surface elongated protrusion forms an apex in the center of said water deflecting surface.

3. A wobbling sprinkler head in accordance with claim 2 in which said water deflecting surface protrusion is generally cone shaped.

4. A wobbling sprinkler head in accordance with claim 1 in which said deflector supporting base has opening therein with said shaft extending therethrough.

5. A wobbling sprinkler head in accordance with claim 4 in which water deflecting head shaft has a spool bushing between the ends thereof riding in said deflecting base opening.

6. A wobbling sprinkler head in accordance with claim 1 in which said opening in said deflector supporting base is large enough to allow said shaft to tilt and wobble during rotation.

7. A wobbling sprinkler head in accordance with claim 1 in which said counterbalancing weight is removably mounted to the other end of said shaft.

8. A wobbling sprinkler head in accordance with claim 7 in which said counterbalancing weight is press fitted into said shaft.

9. A wobbling sprinkler head in accordance with claim 1 in which said deflector supporting base has an open bottom to access said counterbalancing weight.

10. A wobbling sprinkler head in accordance with claim 1 in which said sprinkler head main frame has three arms.

* * * * *